United States Patent [19]

Takahashi

[11] Patent Number: 4,634,264

[45] Date of Patent: Jan. 6, 1987

[54] PHOTOSENSITIVE MEMBER OF RECORDING APPARATUS

[75] Inventor: Sadao Takahashi, Tokyo, Japan

[73] Assignee: Ricoh Company, Ltd., Japan

[21] Appl. No.: 674,177

[22] Filed: Nov. 23, 1984

[30] Foreign Application Priority Data

Nov. 25, 1983 [JP] Japan ..... 58-221752

[51] Int. Cl.[4] ..... G03G 21/00

[52] U.S. Cl. ..... 355/16; 355/3 R; 355/3 BE

[58] Field of Search ..... 355/3 R, 14 R, 3 BE, 355/16

[56] References Cited

U.S. PATENT DOCUMENTS 4,364,656 12/1982 Yanagawa ..... 355/3 R

*Primary Examiner*—Arthur T. Grimley

*Assistant Examiner*—David Warren

*Attorney, Agent, or Firm*—Guy W. Shoup

[57] ABSTRACT

A photosensitive member unit of a recording apparatus including a photosensitive member in the form of an endless belt supported by a plurality of rollers which is movable for recording information from a document on a transfer-printing sheet. The photosensitive member unit further includes a tension roller displaceable with respect to one of the plurality of rollers, and tensioning means operative to move the tension roller when the photosensitive member unit is mounted to a main body of the recording apparatus to thereby tension the photosensitive member in the form of an endless belt. The photosensitive member unit is removably mountable to the recording apparatus, and when it is stored in reserve without being mounted to a recording apparatus, tension is automatically removed from the photosensitive member.

4 Claims, 4 Drawing Figures

PHOTOSENSITIVE MEMBER OF RECORDING APPARATUS

BACKGROUND OF THE INVENTION

This invention relates to photosensitive members of recording apparatus, and more particularly it is concerned with a photosensitive member in the form of an endless belt which is constituted into a unit together with a plurality of rollers supporting and driving it.

In one type of recording apparatus, a photosensitive member in the form of an endless belt is trained over a drive wheel, a tension roller and a support roller, with the drive roller driving the photosensitive member in the form of an endless belt while a suitable tension is being imparted to the photosensitive member by the tension roller.

Generally, a photosensitive member in the form of an endless belt would suffer the disadvantage that it would deteriorate with time due to fatigue, and when this happens, the old photosensitive member should be replaced by a new one. When replacements of the photosensitive member are performed, it has hitherto been usual practice to remove the old photosensitive member in the form of an endless belt from the rollers over which it is trained before a new one is trained over them.

This operation of attaching and detaching the new and old photosensitive members is troublesome and time-consuming, and involves the risk that the hand of an operator might inadvertently touch the surface of the photosensitive member, thereby damaging same.

To obviate this problem, proposals have been made to form the photosensitive member into a unit together with the rollers for supporting and driving it, so that the photosensitive member can be replaced by a new one together with the rollers which form a unit therewith, without having to go to the trouble of detaching and attaching the rollers. This facilitates replacing the old photosensitive member with a new one, thereby improving operability of photosensitive member replacing.

If the photosensitive member in the form of an endless belt were replaced as a unit together with the rollers, a new photosensitive member in the form of an endless belt would be stored in reserve as a unit with the rollers for supporting and driving it. As a result, the photosensitive member would be tensioned while it is being stored in spite of the fact that tensioning the photosensitive member in the form of an endless belt can wait until it is mounted to a recording apparatus. The rollers for supporting and driving a photosensitive member in the form of an endless belt are usually small in diameter. Thus, if the photosensitive member were tensioned while being stored before it is mounted to a recording apparatus, the photosensitive member might be kept in a condition in which it is bent at a sharp angle for a prolonged period of time. The result of this would be that the endless belt would be permanently bent in certain portions. When the photosensitive member in the form of an endless belt that is deformed like this is mounted to a recording apparatus to perform recording of information, images produced on recording sheets would be poor in quality due to improper resolution caused by a floating movement of the photosensitive member in an exposing section, a variation in density from one image to another due to non-uniform charging, and faulty transfer-printing due to non-uniform superposing of transfer-printing sheets on the photosensitive member.

SUMMARY OF THE INVENTION

This invention has been developed for the purpose of obviating the aforesaid problem of the prior art. Accordingly, the invention has as its object the provision of a photosensitive member unit of a recording apparatus which is capable of preventing a photosensitive member in the form of an endless belt from becoming permanently bent in certain portions by removing tension therefrom while being stored as a reserve before being attached to the recording apparatus.

According to the invention there is provided, in a recording apparatus, a photosensitive member unit comprising a photosensitive member in the form of an endless belt trained over a plurality of rollers, a tension roller displaceable with respect to at least one of the plurality of rollers cooperating with the photosensitive member to constitute the photosensitive member unit that can be removably mounted to a main body of the recording apparatus, and tensioning means causing the tension roller to be displaced in a direction in which a tension is imparted to the photosensitive member in the form of an endless belt when the photosensitive member unit is mounted to the main body of the recording apparatus.

DESCRIPTION OF THE PREFERRED EMBODIMENTS

Figure 1:
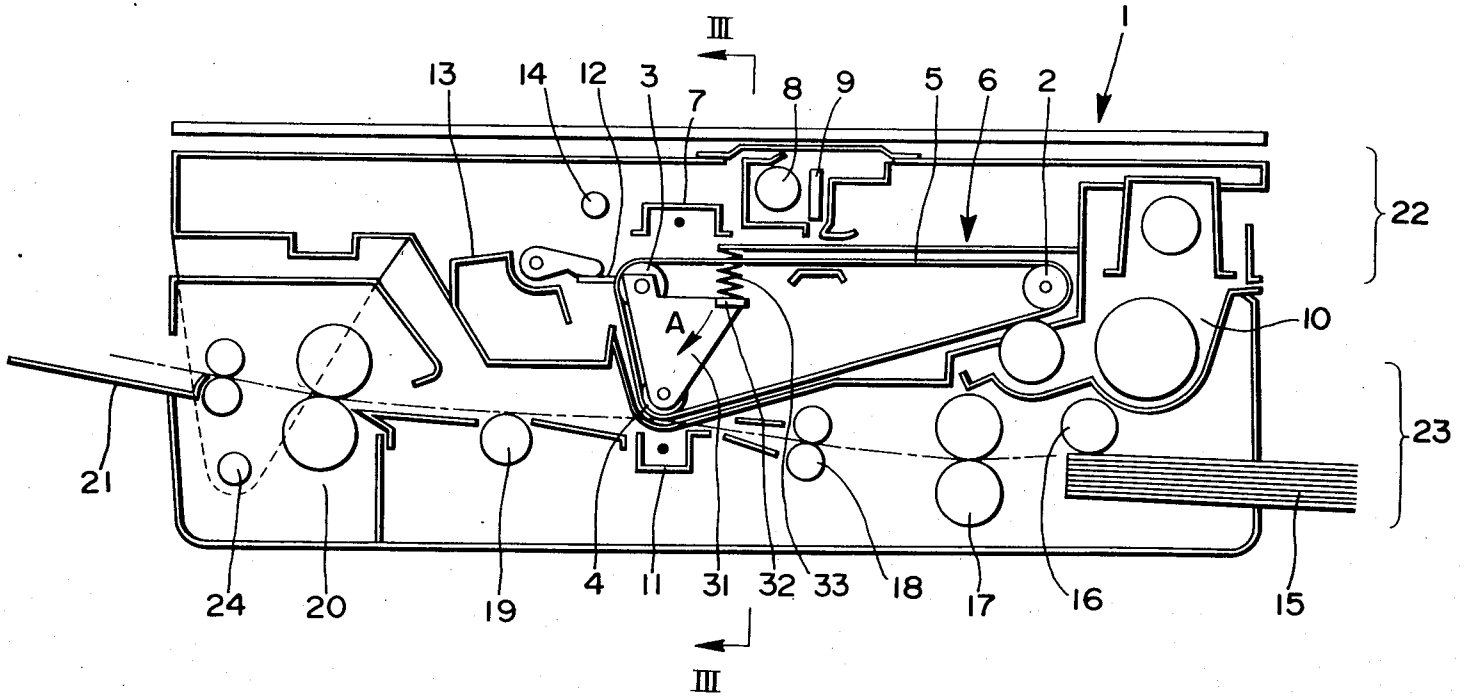
FIG. 1 is a schematic side view of a recording apparatus having mounted to its main body a photosensitive member unit comprising one embodiment of the invention.

Referring to FIG. 1, a main body 1 of a copying apparatus which is a typical recording apparatus mounts therein a drive roller 2, a follower roller 3, a tension roller 4 and a photosensitive member 5 in the form of an endless belt trained over the rollers 2, 3 and 4. The rollers 2, 3 and 4 and the photosensitive member 5 in the form of an endless belt constitute a photosensitive member unit 6. Located around the photosensitive member unit 6 within the main body 1 are devices for performing a copying process, such as a Carlson process, for example, which include a charger device 7, a light source 8, an image forming element 9, a developing unit 10, a transfer-printing charger device 11, a cleaning blade 12, a toner recovery vessel 13 and a charge removing lamp 14. A sheet feeding section is located on the right side of the transfer-printing charger device 11 and includes a sheet feed roller 16 for feeding transfer-printing sheets 15, conveyor/separation rollers 17 and registration rollers 18 arranged in the indicated order. A fixing and discharge section is located on the left side of the transfer-printing charger device 11 and includes a conveyor roller 19, a fixing unit 20 and a sheet ejection tray 21 arranged in the indicated order.

Figure 2:
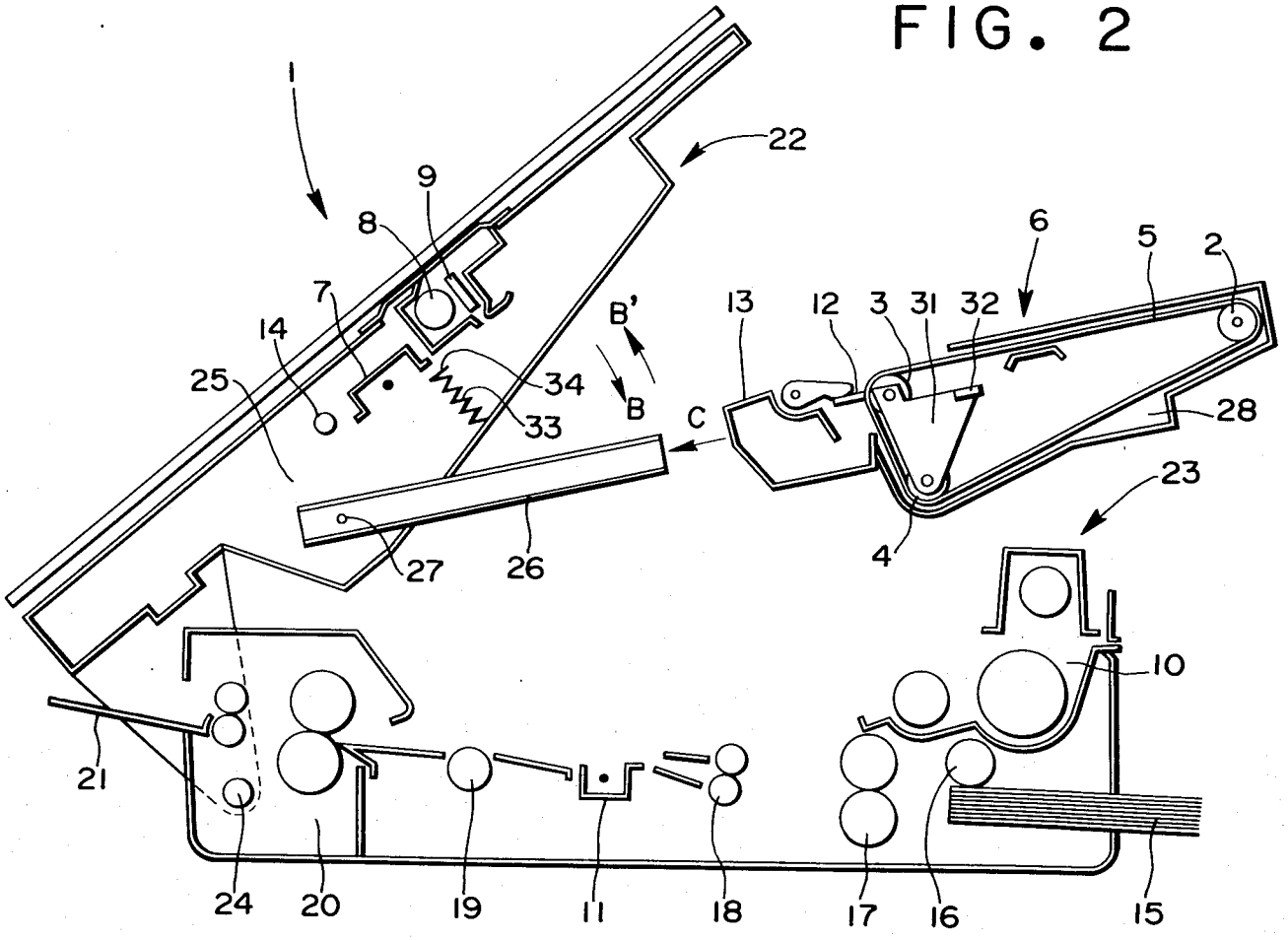
FIG. 2 is a schematic side view of the photosensitive member unit shown in FIG. 1, being shown after being removed from the recording apparatus.
Figure 3:
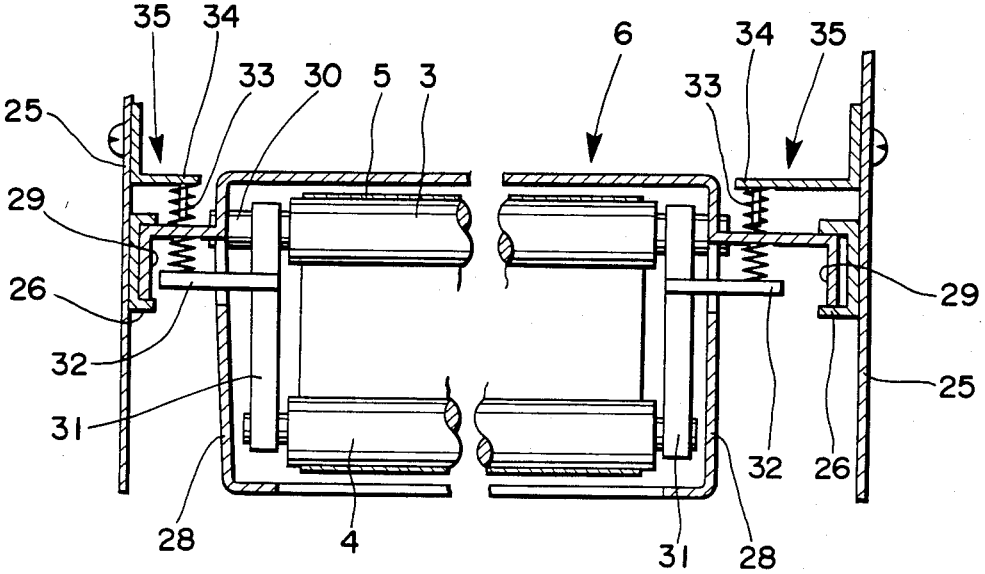
FIG. 3 is a sectional view, shown on an enlarged scale, taken along the line III—III in FIG. 1.

The main body 1 includes an upper structural member 22 and a lower structural member 23. The upper structural member 22 supports the charger device 7, image forming element 9 and toner recovery vessel 13 and forms a unit therewith. The lower structural member 23 supports the registration rollers 18, transfer-printing charger device 11 and fixing unit 20 and forms a unit therewith. As shown in FIG. 2, the upper structural member 22 is movable in an upward direction in pivotal movement about a pivot 24, to open the main body 1. Rails 26 are each supported on an inner side of one of two outer side plates 25 of the upper structural member 22 for pivotal movement in a vertical direction about a pivot 27, and L-shaped members 29 each slidably fitted in one of the rails 26 are supported on one of two side plates 28 of the photosensitive member unit 6 as shown in FIG. 3.

In the photosensitive member unit 6 of the above-mentioned construction, the drive roller 2 and follower roller 3 are each supported by a shaft which in turn is supported by the side plates 28 at opposite ends thereof. The shaft 30 supporting the follower roller 3 has loosely fitted thereto support plates 31 each located at one of opposite end portions thereof inwardly of the side plates 28, to support the tension roller 4. The support plates 31 are each formed with a spring receiver 32 extending outwardly therefrom. Tension imparting means 35 each comprising a spring 33 and a holder 34 for holding an upper end portion of the spring 33 are mounted to one of the outer side plates 25 of the upper structural member 22.

In the photosensitive member unit 6 constructed as described hereinabove and mounted to the main body 1, the lower end of each spring 33 is positioned against the associated spring receiver 32, and the biasing force of the spring 33 urges the associated support plate 31 to move in the direction of an arrow A shown in FIG. 1. Thus, a suitable tension is imparted to the photosensitive member 5 in the form of an endless belt through the tension roller 4, to allow the photosensitive member 5 to move smoothly as the drive roller 2 is rotated.

When the photosensitive member unit 6 is not mounted to the main body 1 of the recording apparatus and it is stored in reserve, the biasing forces of the springs 33 do not act on the support plates 31, and no tension is imparted to the photosensitive member 5 in the form of an endless belt by the tension roller 4, thereby preventing the photosensitive member 5 from being permanently bent in certain portions. Thus, the photosensitive member unit 6 according to the invention never produces recorded images of poor quality which might otherwise result from improper resolution caused by a floating movement of the photosensitive member in endless belt form in an exposing section, a variation in density from one image to another due to non-uniform charging, and faulty transfer-printing due to non-uniform superposing of transfer-printing sheets on the photosensitive member. Also, since the photosensitive member 5 in the form of an endless belt is mounted to the main body 1 as a photosensitive member unit 6, the trouble that the hand of an operator might touch the photosensitive surface layer of the member 5 and damage same can be avoided.

The manner in which the photosensitive member unit 6 is mounted to the main body 1 will be described. The upper structural member 22 of the main body 1 is pivotally moved about the pivot 24 to an upper position as shown in FIG. 2. While the upper structural member 22 is in this position, a locking mechanism, not shown, keeping the rails 26 in a locked position on the side walls 25 of the upper structural member 22 is rendered inoperative, to allow the rails 26 to move in pivotal movement about the pivots 27 in the direction of an arrow B. The L-shaped members 29 (FIG. 3) are slidably fitted in the respective rails 26 to move the photosensitive member unit 6 in the direction of an arrow C. When the photosensitive member unit 6 has moved to a predetermined position, the lower end of each spring 33 is brought into abutting engagement with the associated spring receiver 32. At this time, the photosensitive member unit 6 is moved together with the rails 26 in pivotal movement about the pivots 27 in the direction of an arrow B′ to a predetermined position in which the locking mechanism is rendered operative to lock the photosensitive member unit 6 in place. As the photosensitive member unit 6 is moved in the direction of the arrow B′, the distance between each spring receiver 32 and the associated holder 34 is reduced, to thereby compress the springs 33. This causes the biasing forces of the springs 33 to urge the support plates 31 to move in the direction of the arrow A, to thereby impart a tension to the photosensitive member 6 in the form of an endless belt through the tension roller 4.

Figure 4:
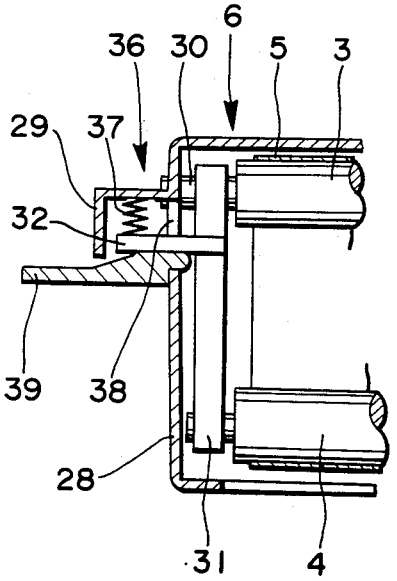
FIG. 4 is a fragmentary sectional view, shown on an enlarged scale, of another embodiment of the photosensitive member unit in conformity with the invention.

The photosensitive member unit comprising another embodiment of the invention will now be described by referring to FIG. 4 in which parts similar to those shown in FIGS. 1–3 and described by referring thereto will be designated by like reference characters and their description will be omitted. In this embodiment, the photosensitive member unit 6 is provided with tension imparting means 36 each comprising a spring 37 secured at an upper end to one of the L-shaped members 29, and a spring receiver 32 against which a lower end of the associated spring 37 is positioned at all times.

The photosensitive member unit 6 provided with the tension imparting means 36 of the above-mentioned construction is mounted to and removed from the main body 1 by slidably fitting the L-shaped members 29 in the respective rails 26 and removing same therefrom, as is the case with the photosensitive member unit 6 of the embodiment shown in FIGS. 1–3. When the photosensitive member unit 6 is not mounted to the main body 1, each support plate 31 is slightly moved about the center axis of the shaft 30 to further compress the associated spring 37, to thereby remove the tension that has been imparted to the photosensitive member 5 in the form of an endless belt by the biasing forces of the springs 37 through the support plates 31 and tension roller 4. A wedge 39 is inserted in an opening 38 formed in each side plate 28 and brought into abutting emgagement with an underside of the associated spring receiver 32, to prevent the associated holding plate 31 from moving about the center axis of the shaft 30. Thus, the photosensitive member 5 in the form of an endless belt is kept in a condition in which it is free from tension, thereby avoiding the photosensitive member 5 in the form of an endless belt being permanently bent in certain portions while being stored in reserve.

When it is desired to mount the photosensitive member unit 6 to the main body 1, the wedges 39 are withdrawn from the openings 38. This allows the biasing forces of the springs 37 to urge the holding plates 31 to move in the direction of arrow A about the center axis of the shaft 30 in the same manner as described hereinabove by referring to FIG. 1, so that a tension is imparted to the photosensitive member 5 through the tension roller 4. If the operator inadvertently tries to mount the photosensitive member unit 6 to the main body 1 without removing the wedges 39, outer ends of the wedges 39 would abut against the outer side plates 25 of the upper structural member 22, making it impossible to mount the photosensitive member unit 6 to the main body 1. The presence of the wedges 39 avoids the photosensitive member unit 6 being mounted to the main body 1 without the photosensitive member 5 being tensioned.

While the invention has been described as being incorporated in a copying apparatus, it is to be understood that the photosensitive member unit according to the invention can have application not only in a copying apparatus but also in any type of recording apparatus.

What is claimed is:

1. A recording apparatus comprising:

(a) a main body having an upper structure pivotally mounted to a lower structure, said upper structure being pivotally movable toward or away from the lower structure to close or open the recording apparatus;

(b) a photosensitive unit removably mountable in said main body comprising a photosensitive endless belt member trained over supporting rollers, a support plate movably mounted in the photosensitive unit, and a tension roller mounted on the support plate so as to be movable to or from a tensioning position against said belt with respect to said supporting rollers; and (c) tensioning means having one end engaged with one of said structures of the main body and its other end adapted to engage said support plate to move said tension roller to the tensioning position against said endless belt when said photosensitive unit is mounted in a predetermined position in said main body;

wherein said upper structure includes rails pivotally movable apart from said upper structure, and said photosensitive unit further comprises side plates adapted to be slid onto said rails to mount said photosensitive member, said one end of said tensioning means being mounted in said upper structure, and said rails and mounted photosensitive unit being pivotally movable toward said upper structure to move said photosensitive unit to the predetermined position for tensioning said tension roller.

2. A photosensitive member unit as claimed in claim 1, wherein said tensioning means further comprises a spring, and a holder for holding said spring at one end thereof, and wherein said photosensitive member unit further comprises a plurality of support plates each loosely connected at one end thereof to a support shaft on one of said plurality of rollers for movement about a center axis of the support shaft and supporting at an opposite end thereof said tension roller, each said support plate including a spring receiver having an opposite end of said spring positioned thereagainst, whereby said spring urges by its biasing force the support plate to cause the tension roller to impart a tension to the photosensitive member in the form of an endless belt.

3. A photosensitive member unit as claimed in claim 2, wherein said holder for holding said spring at one end thereof is attached to the main body of the recording apparatus, and when the photosensitive member unit is mounted to the main body of the recording apparatus, the spring is compressed by the spring receiver and urges by its biasing force the support plate to impart a tension to the tension roller.

4. A photosensitive member unit as claimed in claim 1, wherein said tensioning means comprises a spring supported at one end by an L-shaped member of the photosensitive member unit, and wherein said photosensitive member unit further comprises a plurality of support plates each loosely connected at one end thereof to a support shaft of one of said plurality of rollers for movement about a center axis of the support shaft and supporting at an opposite end thereof said tension roller, each said support plate including a spring receiver against which an opposite end of said spring is positioned at all times, and a wedge inserted in an opening formed in a side wall of said photosensitive member unit and operative, when the photosensitive member unit is removed from the recording apparatus, to move one of said support plates to shift the tension roller to a position in which no tension is imparted to the photosensitive member in the form of an endless belt.

* * * * *